United States Patent [19]

Deters

[11] 3,981,334

[45] Sept. 21, 1976

[54] LIQUID DISPENSING AND VAPOR RECOVERY SYSTEM UTILIZING AN INJECTOR AND AN IMPROVED VAPOR FLOW CONTROL UNIT

[75] Inventor: Elmer M. Deters, Muscatine, Iowa

[73] Assignee: Weil-McLain Co., Inc., Dallas, Tex.

[22] Filed: Apr. 4, 1975

[21] Appl. No.: 565,123

[52] U.S. Cl. ..... 141/46; 141/59; 222/318; 55/184; 55/338

[51] Int. Cl.[2] ..... B67D 5/04

[58] Field of Search ..... 222/52, 318; 141/7, 141/8, 37, 40–47, 50, 52, 53, 54, 55, 59, 94, 115, 123, 137, 198, 287; 73/40, 40.5, 49.2, 49.3; 137/555; 220/85 UR, 85 US; 55/184, 338

[56] References Cited

UNITED STATES PATENTS

| | | | |
|---|---|---|---|
| 2,401,124 | 5/1946 | Walker | 141/37 |
| 2,919,834 | 1/1960 | Nugeley et al. | 222/52 |
| 3,454,195 | 7/1969 | Deters | 222/52 |
| 3,905,405 | 9/1975 | Fowler et al. | 222/318 X |
| 3,913,633 | 10/1975 | Hiller | 141/59 X |

*Primary Examiner*—Robert B. Reeves
*Assistant Examiner*—Charles A. Marmor
*Attorney, Agent, or Firm*—Lane, Aitken, Dunner & Ziems

[57] ABSTRACT

A liquid dispensing and vapor recovery system in which a control unit is connected to a storage tank for the liquid and directs the liquid to a pair of conduits which pass the liquid to a receptacle and back to the storage tank, respectively. A reduced pressure zone is established in the conduit connected to the storage tank and is in communication with the receptacle for drawing vapors from the receptacle for passage back to the storage tank. The control unit prevents the flow of liquid back to the storage tank until gasoline is delivered to the receptacle and modulates the vapor flow back to the storage tank in response to the flow through the conduit connected to the receptacle.

7 Claims, 5 Drawing Figures

LIQUID DISPENSING AND VAPOR RECOVERY SYSTEM UTILIZING AN INJECTOR AND AN IMPROVED VAPOR FLOW CONTROL UNIT

BACKGROUND OF THE INVENTION

This invention relates to a liquid dispensing and vapor recovery system and, more particularly, to such a system in which liquid is dispensed from a storage tank to a receptacle while vapors from the receptacle are drawn to the storage tank.

With the increased emphasis on preventing pollution of the atmosphere, recent attention has been directed to minimizing the introduction of gasoline vapors into the atmosphere from both permanent type underground storage tanks for the gasoline, and from the vehicles into which the gasoline is ultimately dispensed.

Gasoline vapors can easily be recovered from underground storage tanks by providing a separate vapor return line which connects the storage tank to the transport truck which periodically fills the tank. In this manner, the gasoline introduced into the tank from the transport truck will displace the vapors and force them through the vapor recovery line to the truck whereby they are ultimately disposed of either by burning or through compression-refrigeration systems.

However, it has been extremely difficult to devise a satisfactory vapor recovery system from the gasoline tanks of vehicles. For example, previous proposals have utilized what is commonly referred to as a balanced displacement system in which the gasoline entering the tank forces the vapors through a separator line to the storage tank. However, this system has been less than satisfactory for several reasons, one of which is the difficulty in creating a proper seal between the gasoline dispensing and recovery nozzle and the automobile tank.

Although it has also been suggested to use a vacuum pump or a blower to remove the vapors from the vehicle tanks, this type of installation is disadvantageous from several standpoints. For example, the pump or blower is relatively expensive and creates potential safety problems due to the fact that it is electrically operated. Also, the output from the pump or blower is passed directly into the storage tank which pressurizes the tank and therefore increases vapor losses from the tank through its vent pipe.

Several recent developments have featured the use of an injector which establishes a reduced pressure zone in response to fluid flow from the storage tank to the vehicle receptacle, with the reduced pressure zone functioning to draw the vapors from the receptacle back to the tank. For example, in copending U.S. Pat. application Ser. No. 534,448, filed by Trueman Hiller and Klaus Jarr on Dec. 19, 1974, and assigned to the same assignee as the present invention, a gasoline dispensing and vapor recovery system is disclosed which incorporates such an injector in combination with a valve for regulating the amount of vapor recovered in response to the amount of gasoline dispensed.

Although this system has advanced the state of the art, the above-mentioned valve is relatively complex both with respect to structure and function. Also, the system is incompatible with leak detector systems which are often incorporated in such installations due to the fact that, in the system disclosed in the above application, a portion of the flow from the main conduit extending from the storage tank to the vehicle receptacle is continuously diverted through the injector for establishing the reduced pressure zone before it is passed back to the storage tank. However, since the type of leak detector often utilized in these type systems responds to the existence of a relatively high pressure in the main conduit extending from the storage tank, the leak detector would be rendered inoperable since the value of this pressure is insufficient by virtue of the continuous diversion of the flow.

SUMMARY OF THE INVENTION

It is, therefore, an object of the present invention to provide a liquid dispensing and vapor recovery system in which liquid is dispensed from a storage tank to a receptacle while vapors in the receptacle are recovered and delivered back to the storage tank.

It is a further object of the present invention to provide a liquid dispensing and vapor recovery system of the above type in which an injector is used to create a vacuum in response to the dispensing of the liquid from the storage tank to the receptacle, and is utilized to draw the vapors from the receptacle back to the tank.

It is a further object of the present invention to provide a liquid dispensing and vapor recovery system of the above type in which the vapor recovery is made in proportion to the liquid dispensed.

It is a further object of the present invention to provide a liquid dispensing and vapor recovery system of the above type which can be used in installations employing a leak detector which is responsive to pressures in the main gasoline delivery line.

It is a further object of the present invention to provide a liquid dispensing and vapor recovery system of the above type in which a single control unit is provide which enables vapor recovery to be made in proportion to the liquid dispensed and which enables a leak detector of the above type to be used.

It is a further object of the present invention to provide a liquid dispensing and vapor recovery system of the above type which is relatively simple in operation and relatively low in cost.

Toward the fulfillment of these and other objects, the system of the present invention comprises storage means for the liquid, dispensing means for dispensing the liquid to a receptacle, first conduit means adapted to connect the storage means to the dispensing means, pump means for pumping the liquid from the storage means through the first conduit means and to the dispensing means, second conduit means connected to the first conduit means and to the storage means for diverting a portion of the liquid in the first conduit means back to the storage means, means for forming a reduced pressure zone in the second conduit means in response to liquid flow through the second conduit means, third conduit means connected to the second conduit means at the reduced pressure zone and the receptacle for drawing the vapors from the receptacle into the second conduit means for passage into the storage means, and a control unit associated with at least one of the conduit means for preventing the flow of the liquid through the second conduit means until the dispensing of the liquid by the dispensing means and for modulating the drawing of vapors into the second conduit means in response to liquid flow through the first conduit means.

DESCRIPTION OF THE PREFERRED EMBODIMENTS

Figure 1:
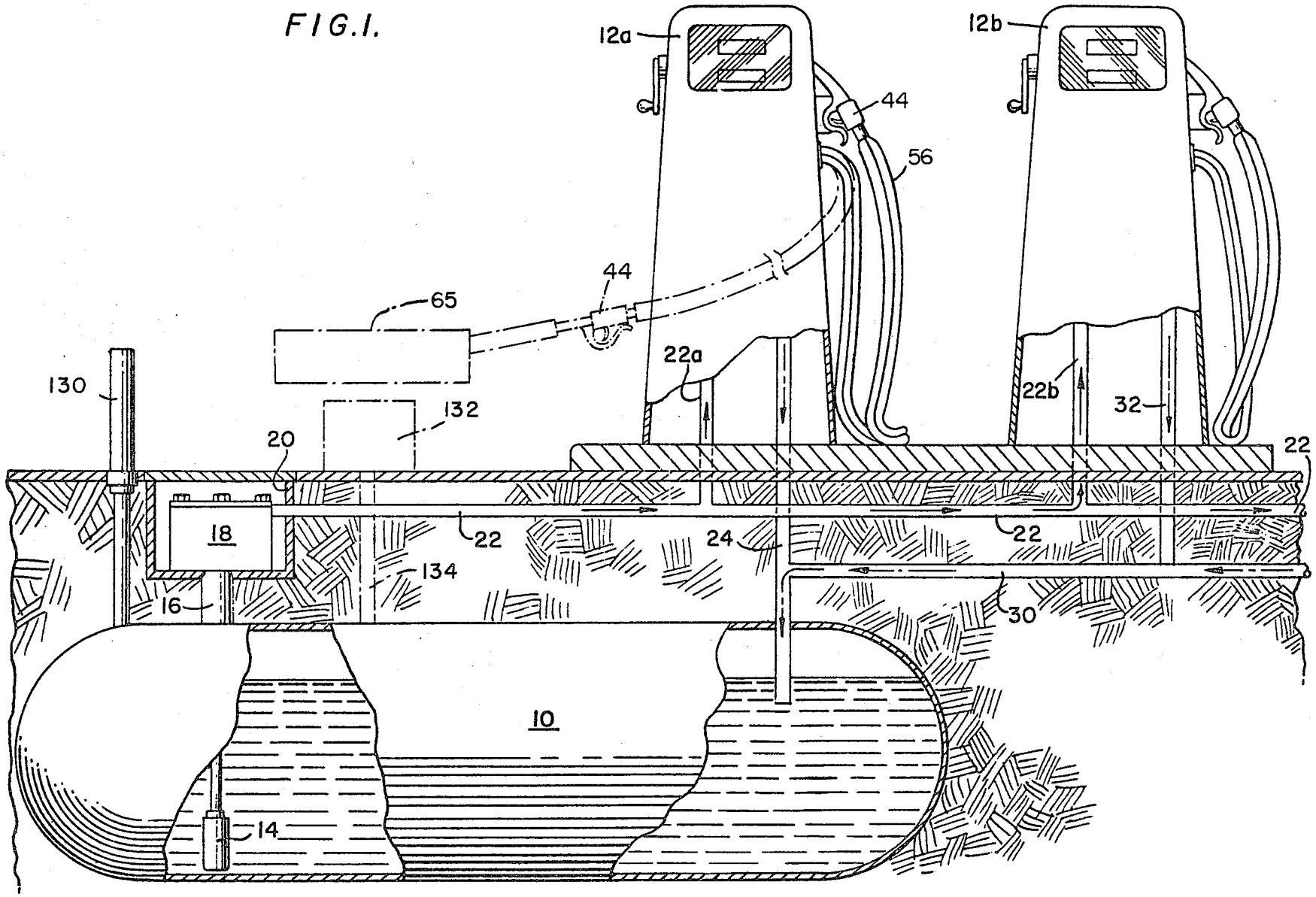
FIG. 1 is a partial schematic, partial elevational view of a service station installation having the dispensing and vapor recovery system of the present invention utilized therein.

As an example of the use of the liquid dispensing and vapor recovery system of the present invention, it will be described in connection with a gasoline dispensing installation for use in service stations or the like. Such an installation is illustrated in FIG. 1, and includes an underground tank 10 for storing a quantity of gasoline which is delivered to two dispensing units, or pedestals, 12*a* and 12*b*. An electrically operated, centrifugal type submersible pump 14 is disposed in the tank and operates to draw the gasoline into the unit through a plurality of intake ports disposed at the bottom thereof, and to force the gasoline upwardly around a sealed electrical drive motor.

A casing 16 is attached to the tank 10 and extends upwardly therefrom to connect the outlet of the pump 14 to a discharge head, or manifold, 18 which is preferably disposed below ground level in a well 20. The manifold 18 is described in detail in U.S. Pat. No. 3,183,723, the disclosure of which is hereby incorporated by reference. Therefore, for the convenience of presentation, its structural details are not shown in the drawings, it being understood that it supports the upper portion of the pump unit 14 while permitting the electrical connections for the drive motor to be brought outwardly for connection to the proper controls. It is also understood that an adapter unit, or packer, is supported within the housing of the manifold 18 and has an inlet chamber communicating with the outlet of the pump 14, an outlet chamber adapted for registration with a substantially horizontal main conduit 22, and a check valve to permit the flow of gasoline from the pump 14 to the conduit 22 while preventing flow in the opposite direction, also in a conventional manner. It is further understood that a leak detector is mounted on the above-mentioned packer and operates to detect any leakage of gasoline from the system.

A pair of substantially vertical branch conduits 22*a* and 22*b* connect the main conduit 22 to the pedestals 12*a* and 12*b*, respectively, for delivering the gasoline to the pedestals.

A substantially vertical vapor recovery conduit 24 extends from the pedestal 12*a* into the tank 10 and terminates in the upper portion of the tank. A horizontal vapor recovery conduit 30 is connected to the conduit 24, and to a substantially vertical conduit 32 extending from the pedestal 12*b*, so that vapor from the latter pedestal is introduced into the conduit 24 for passage into the tank 10. It is noted from the drawings that in installations having more than two pedestals, the conduits 22 and 30 can be extended to connect with other vertical conduits of the additional pedestals.

Figure 2:
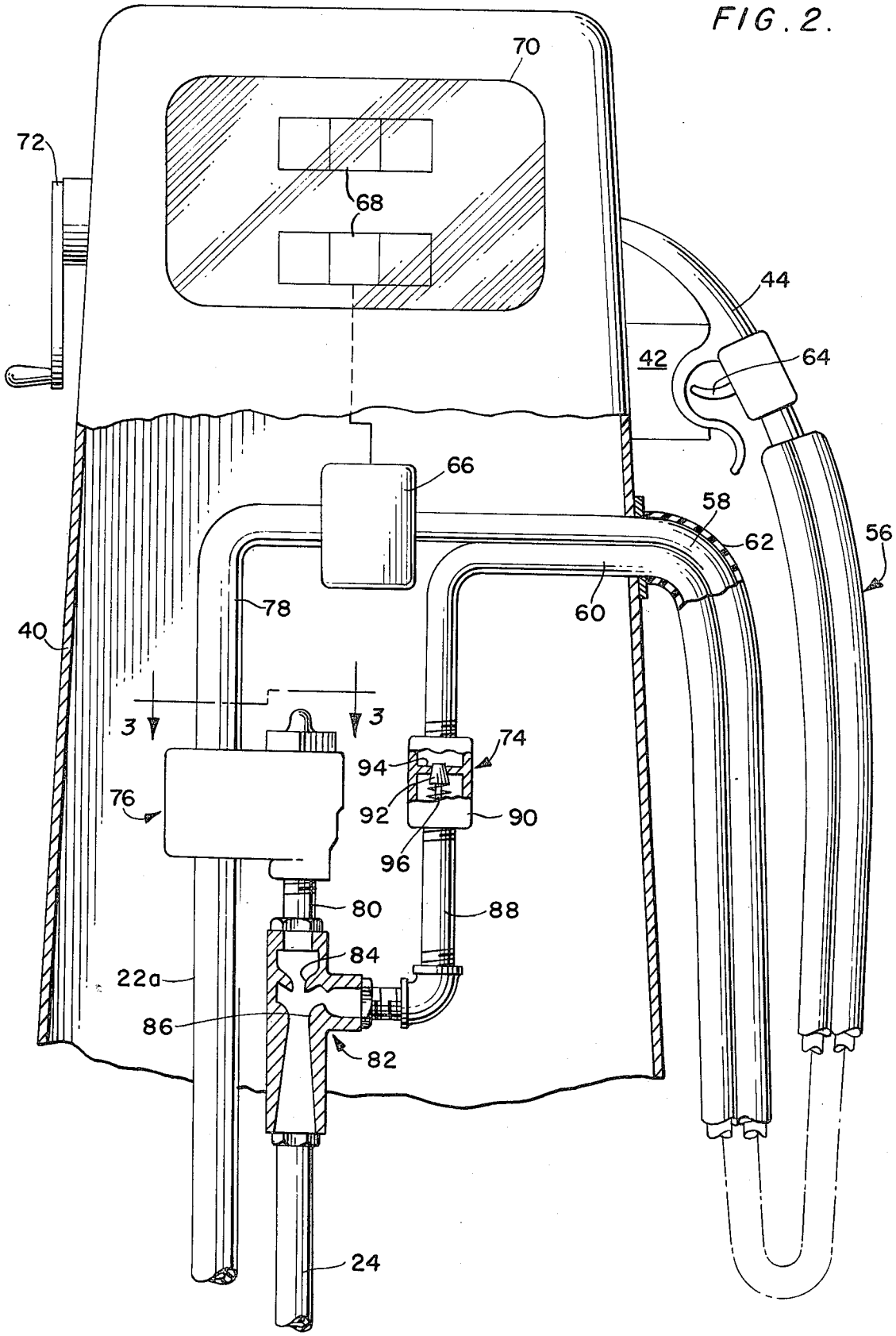
FIG. 2 is an enlarged partial sectional, partial elevational view of a portion of dispensing unit utilized in the installation of FIG. 1.

FIG. 2 depicts the details of pedestal 12*a* and its internal components, it being understood that pedestal 12*b* is constructed and arranged in an identical manner. In particular, the pedestal 12*a* consists of a housing 40 having a support and switch assembly 42 supported on its upper outer surface which is adapted to support a dispensing unit 44. Although not shown in the drawings, it is understood that the assembly 42 includes a switch which operates to actuate the pump unit 14 in a conventional manner. The dispensing unit 44 is connected to one end of a hose assembly 56, with the other end portion of the latter assembly extending through and into the housing 40. The hose assembly 56 includes a pair of juxtapositioned hoses 58 and 60 surrounded by a protective cover 62. It is understood that the dispensing unit 44 includes a gasoline dispensing nozzle connected to the hose 58 and a vapor recovery conduit connected to the hose 60. The dispensing unit 44 is operated by a manually operated valve 64 in a conventional manner to dispense gasoline into a receptacle 65 (FIG. 1) which, in a great majority of instances, would be in the form of vehicle gasoline tank.

In the interior of the housing 40, the other end of the hose 58 is connected to the outlet of a meter 66 which is mechanically connected to a pair of registers 68 disposed behind a window 70 in the pedestal housing 40. The registers 68 are operated by a crank 72 and are adapted to display the quantity and cost of the gasoline dispensed. Since the meter 66 and the registers 68 are of a conventional design, they are not shown, nor will be described, in any further detail.

The end of the hose 60 extending within the housing 40 is connected to an outlet of a check valve unit 74 which will be described in detail later.

The branch conduit 22*a* is connected to a control unit 76 in the housing 40, and a conduit 78 connects an outlet of the control unit to the meter 66 for permitting a portion of the gasoline from the conduit 22*a* to be passed through the meter and to the hose 58 for passage to the dispensing unit 44. The control unit 76 is adapted to divert a portion of the gasoline received from the conduit 22*a* in a manner to be described in detail later, and has an additional outlet which registers with a relatively short bypass pipe 80.

An injector, shown in general by the reference numeral 82, has an inlet connected to the pipe 80 for receiving the diverted gasoline flow from the control unit 76, and an outlet connected to the conduit 24 for passing the diverted gasoline back into the tank 10. A nozzle 84 and a venturi 86 are formed in the injector 82 and cooperate to form a reduced pressure zone at the throat portion of the venturi upon a flow of the gasoline through the injector, in a conventional manner. A conduit 88 connects the injector 82 to the valve unit 74 for reasons to be described in detail later.

The valve unit 74 consists of a housing 90 having a chamber formed therein which communicates with the conduit 88 and the hose 60. A tapered valve member 92 is disposed in the latter chamber and cooperates with a seat 94 formed in the housing 90. A spring 96 urges the valve member 92 into a flow blocking position against the seat 94. The valve unit 74 thus prevents the flow of gasoline from the injector 82 through the conduit 88, and operates to permit vapor flow from the hose 60 to the conduit 88 in response to a negative fluid pressure occurring in the conduit 88 of a sufficient magnitude to force the valve member 94 to move in a downwardly direction as viewed in FIG. 2.

Figure 3:
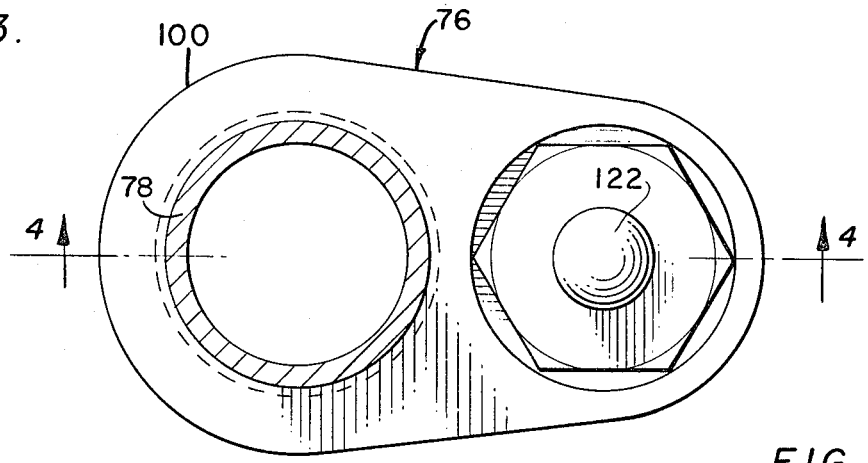
FIGS. 3 and 4 are cross-sectional views taken along the lines 3—3 and 4—4 of FIGS. 2 and 3, respectively.
Figure 4:
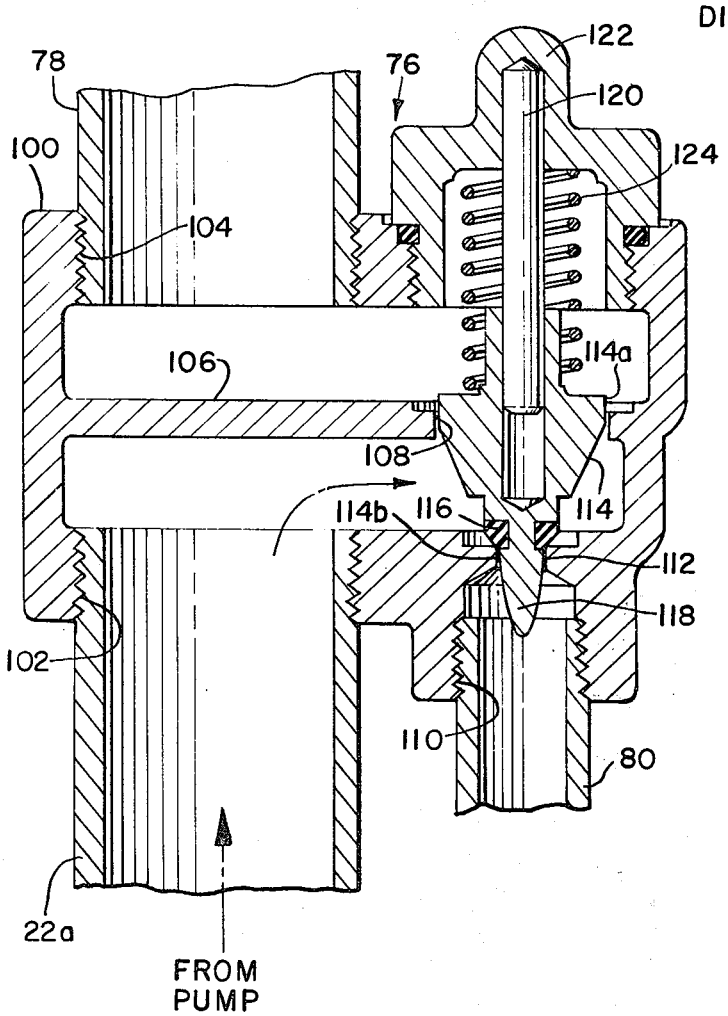
Figure 5:
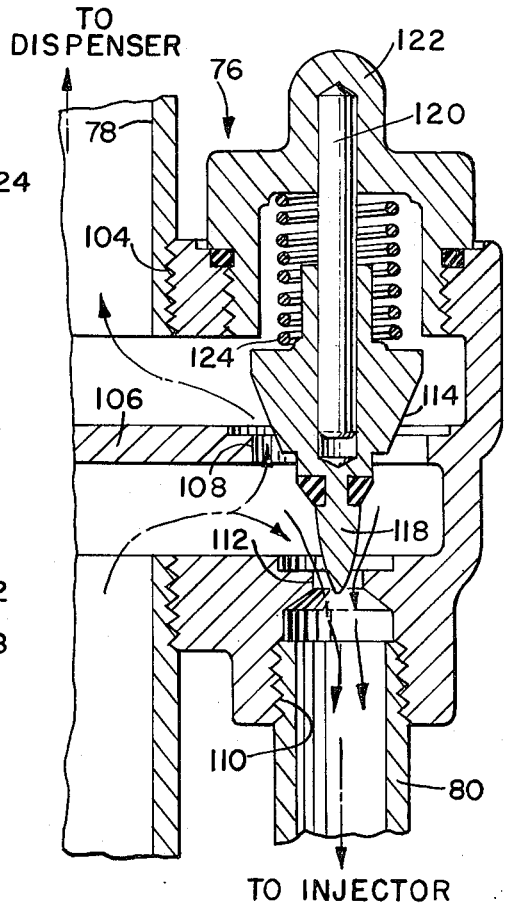
FIG. 5 is a view similar to FIG. 4, but depicting the component of FIG. 4 in a different operating mode.

The control unit 76 is depicted in detail in FIGS. 3–5. The unit 76 consists of a housing 100 having an internally threaded inlet 102 adapted for connection to a threaded end portion of the conduit 22*a*, and an internally threaded outlet 104 adapted for connection in a similar manner to the conduit 78. A partition 106 is disposed in the housing 100 and defines an offset valve seat 108 which, in turn, defines an opening through which gasoline can flow from the inlet 102 to the outlet 104.

The housing 100 defines an additional outlet 110 which is internally threaded and adapted to receive a threaded end portion of the conduit 80. An additional valve seat 112 is also defined within the housing 100 and is in a coaxial relationship with the valve seat 108. The seat 112 defines an opening which communicates the interior of the housing 100 with the conduit 80.

As shown in FIG. 4, a valve head 114 is disposed in the housing 100 and has an outer surface 114*a* formed in a manner to extend within the valve seat 108 with a minimal clearance, and a second surface 114*b* adapted to extend within the valve seat 112. An O-ring seal member 116 extends around the valve head 114 in a position to seal the opening defined by the valve seat 112 in the closed position of the head. As a result, when the valve head 114 is in the position of FIG. 4, gasoline flow through the valve seat 112 is blocked while very slight flow occurs through the exposed opening defined by the valve seat 108, for reasons that will be described in detail later. The outer surface of the valve head 114 extending between the surfaces 114*a* and 114*b* is tapered and the valve head 114 has an end portion 118 extending from the seal member 116 which is tapered inwardly as shown so that axial movement of the valve head 114 will vary the size of the opening defined by the seat 112 that is exposed and thus modulate the rate of flow through this opening.

A valve stem 120 has one end portion extending within a corresponding bore formed in the valve head 114 and another end portion extending within a sub-housing 122 which is in threaded engagement with a corresponding opening formed in the housing 100. A spring 124 engages an inner surface formed in the sub-housing 122 and a shoulder portion of the valve head 114, to urge the valve head in a generally downward direction as viewed in FIG. 4, so that the surfaces 114*a* and 114*b* of the valve head extend within the valve seats 108 and 112, respectively.

In operation, upon an operator releasing the dispensing unit 44 from its support and switch assembly 42 on the pedestal 12*a*, for example, an actuating the associated switch, the pump 14 will be actuated to pump gasoline from the tank 10, through the manifold 18 and the leak detector associated therewith, and through the conduits 22 and 22*a*. During the initial operation of the pump 14, and before the valve 64 is actuated to commence dispensing of the gasoline from the dispensing unit 44, the fluid pressure in the conduit 22*a* acting against the tapered portion of the outer surface of the valve head 114 will force the valve head upwardly to its open position shown in FIG. 5 whereby gasoline flows into the conduits 78 and 80 as shown by the flow arrows. The pressure in the conduit 78 will rapidly build up and, when sufficient to balance the pressure in the conduit 22*a*, the force of the spring 124 will urge the valve head 114 downwardly to the position of FIG. 4. In the later position, the flow of gasoline to the conduit 80 will be blocked by the seal member 116 acting against the seat 112, and a relatively low flow will occur through the slight clearance between the surface 114*a* of the valve head 114 and the opening defined by the valve seat 108. This latter flow will pass into the conduit 78 and will maintain the pressure balance across the valve head 114. The pressure in the conduit 22*a* will thus build up to an extend that the leak detector can operate to detect the presence or absence of a substantial leak in the system, as disclosed in the above-identified patent.

Assuming that no substantial leak in the system does, in fact, exist, upon actuation of the valve member 64 of the dispensing unit 44, the gasoline in the conduit 78 will be dispensed from the dispensing unit into the receptacle 65. As a result, the pressure in the conduit 78 will be relieved and the pressure in the conduit 22*a* will force the valve head 114 upwardly to its open position of FIG. 5 to permit a continuous flow of gasoline through the exposed opening defined by the valve seat 108 and through the conduit 78, the meter 66, the hose 58, and the dispensing unit 44 for introduction into the receptacle 65.

In the foregoing operation, when the valve head 114 is in its open position of FIG. 5, a portion of the gasoline flowing into the valve unit 76 will be diverted through the exposed opening defined by the valve seat 112 and into the pipe 80 and will pass into the injector 82, where it passes through the nozzle 84 and the venturi 86 before passing into the vapor recovery conduit 24 and back to the tank 10. As a result, a reduced pressure zone will be formed in the injector 82 which is transferred, through the conduit 88, to the valve unit 74. If the negative pressure applied to the valve member 92 of the unit 74 is sufficient to pull it in a generally downwardly direction as viewed in FIG. 2 against the force of the spring 96, the opening defined by the valve seat 94 will be exposed and the negative pressure will be transmitted to the receptacle 65, via the hose 60 and the dispensing unit 44. This negative pressure, plus the force of the gasoline as it displaces the vapors from the vehicle tank, will cause the vapors to pass from the vehicle tank into and through the dispensing unit 44 and the hose 60 where they pass through the valve seat 94, the conduit 88 and into the injector 82. In the injector 82, the vapors pass through the venturi 86 where they are mixed with the gasoline passing through the injector. The resulting mixture then passes from the injector 82, through the conduit 24, and into the tank 10. The vapors are at least partially absorbed by the gasoline passing through the injector 82 and the conduit 24, and those vapors not absorbed will either condense in the tank 10 or can be recovered by the gasoline transport truck in the manner discussed above.

Any change in the flow rate of the gasoline passing through the conduit 22*a* will be accompanied by a corresponding change in the position of the end portion 118 of valve head 114 relative to the opening defined by the seat 112, and therefore a corresponding change in the gasoline flow rate through the injector 82. As a result, the amount of vapor drawn from the vehicle tank by the injector 82 is modulated in proportion to the gasoline flow through the system.

It is noted from FIG. 1 that the storage tank 10 is provided with a vent pipe 130 for exhausting vapor from the tank which may form due to diurnal losses and that an optional condenser system 132 may be provided which is connected to the tank 10 via a line 134 and which operates to condense any excessive vapors in the tank 10. Since this type of condenser system is well known in the art, it will not be described in any further detail.

It is thus seen that several advantages are achieved by virtue of the system of the present invention. For example, a precise control of the amount of vapor recovered can be achieved, thus permitting the system to be used in installations of varying capacity. Also, a leak detector of the type described above can be used in the present system. Also, the components utilized are relatively simple in structure and function, and the above advantages are achieved while permitting a leak detector of the above type to be utilized in the system.

It is understood that the use of the valve 76 is not limited to the specific environment discussed above, but can be incorporated in any system in which an injector is used. It is also understood that the system of the present invention is not limited bo the dispensing of gasoline and the recovery of gasoline vapors but could be applied to any installation, such as chemical plants, or the like, in which vapor recovery is desired.

Of course, other variations of the specific construction and arrangement of the system disclosed above can be made by those skilled in the art without departing from the invention as defined in the appended claims.

I claim

1. A liquid dispensing and vapor recovery system comprising storage means for said liquid, dispensing means for dispensing said liquid to a receptacle, first conduit means adapted to connect said storage means to said dispensing means, pump means for pumping said liquid from said storage means through said first conduit means and to said dispensing means, second conduit means connected to said first means and to said storage means for diverting a portion of said liquid in said first conduit means back to said storage means, a housing defining a first passage forming a portion of said first conduit means and a second passage communicating with said first passage and forming a portion of said second conduit means, first valve means disposed in said first passage and movable in response to changes in the flow rate of said liquid through said first conduit means, means responsive to the absence of a predetermined liquid flow rate in said first conduit means for urging said first valve means to a position in said first passage in which the flow of liquid through said first conduit means is reduced, second valve means disposed in said second passage and movable in response to said movement of said first valve means for continuously changing the flow rate of liquid through said second passage means, said second valve means preventing the flow of liquid through said second passage upon said first valve member moving to said position, means for forming a reduced pressure zone in said second conduit means in response to liquid flow through said second conduit means, and third conduit means connected to said reduced pressure zone and to said receptacle for permitting the vapors to pass from said receptacle into said second conduit means for passage into said storage means.

2. The system of claim 1, wherein said second valve means is formed integral with said first valve means.

3. The system of claim 1, further comprising means forming a first and second valve seat in said first and second passages respectively, said first and second valve means cooperating with said first and second valve seats respectively.

4. The system of claim 1, further comprising third valve means disposed in said third conduit means for preventing the flow of said vapors through said third conduit means in the absence of a predetermined minimum negative pressure at said reduced pressure zone.

5. The system of claim 1, wherein said means for forming a reduced pressure zone comprises a nozzle and a venturi disposed in said second conduit means.

6. The system of claim 1, wherein said dispensing means connects said third conduit means to said receptacle.

7. The system of claim 1, wherein said liquid is fuel, said storage means is an underground storage tank, and said receptacle is a vehicle fuel tank.

* * * * *

UNITED STATES PATENT OFFICE
CERTIFICATE OF CORRECTION

Patent No. 3,981,334 Dated September 21, 1976

Inventor(s) Elmer M. Deters

It is certified that error appears in the above-identified patent and that said Letters Patent are hereby corrected as shown below:

Column 2, line 59 insert --to-- after "and".

Column 4, line 22 insert --a-- after "of".

Column 6, line 7 change "extend" to --extent--.

Column 7, line 14 insert --unit-- after "valve".

Column 7, line 35 insert --conduit-- after "first".

Signed and Sealed this

Fifteenth Day of February 1977

[SEAL]

*Attest:*

RUTH C. MASON
*Attesting Officer*

C. MARSHALL DANN
*Commissioner of Patents and Trademarks*